US010539891B1

(12) United States Patent
Ishii et al.

(10) Patent No.: US 10,539,891 B1
(45) Date of Patent: Jan. 21, 2020

(54) ELECTROPHOTOGRAPHIC MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Toru Ishii, Mishima (JP); Kazutoshi Ishida, Mishima (JP); Wataru Moriai, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/434,342

(22) Filed: Jun. 7, 2019

(30) Foreign Application Priority Data

Jun. 28, 2018 (JP) ..... 2018-123388

(51) Int. Cl.

| | |
|---|---|
| ***G03G 5/00*** | (2006.01) |
| ***G03G 5/14*** | (2006.01) |
| ***G03G 21/18*** | (2006.01) |
| ***G03G 5/02*** | (2006.01) |
| ***G03G 5/05*** | (2006.01) |
| ***G03G 5/09*** | (2006.01) |

(52) U.S. Cl.
CPC ..... *G03G 5/144* (2013.01); *G03G 5/0217* (2013.01); *G03G 5/0507* (2013.01); *G03G 5/09* (2013.01); *G03G 21/1814* (2013.01)

(58) Field of Classification Search
CPC ..... G03G 5/0217; G03G 5/0507; G03G 5/09
USPC ..... 430/56
See application file for complete search history.

(56) References Cited

U.S. PATENT DOCUMENTS

| | | | |
|---|---|---|---|
| 7,798,948 | B2 | 9/2010 | Kawamura et al. |
| 8,600,273 | B2 | 12/2013 | Yamada et al. |
| 8,660,472 | B2 | 2/2014 | Kurachi et al. |
| 8,706,011 | B2 | 4/2014 | Anan et al. |
| 8,837,985 | B2 | 9/2014 | Ishida et al. |
| 8,846,287 | B2 | 9/2014 | Yamada et al. |

(Continued)

FOREIGN PATENT DOCUMENTS

| | | |
|---|---|---|
| JP | H05-266716 | 10/1993 |
| JP | 2008-139482 | 6/2008 |

(Continued)

OTHER PUBLICATIONS

U.S. Appl. No. 16/280,201, Yuji Sakurai, filed Feb. 20, 2019.

(Continued)

*Primary Examiner* — Mark A Chapman
(74) *Attorney, Agent, or Firm* — Venable LLP

(57) ABSTRACT

There is provided an electrophotographic member which suppresses scraping and contamination of a surface even in the durable use of multiple sheet printing under a high temperature environment. The electrophotographic member has an electroconductive substrate and a single elastic layer as a surface layer, the surface layer includes a binder resin and carbon black dispersed in the binder resin, the carbon black has a volatile content of 0.4% or more, the binder resin includes a crosslinked urethane resin and a crosslinked acrylic resin, and the surface layer has a first area in which the crosslinked urethane resin and the crosslinked acrylic resin form an interpenetrating polymer network structure, the first area being from an outer surface of the surface layer to a depth of 0.1 μm in the surface layer.

11 Claims, 5 Drawing Sheets

(56) References Cited

U.S. PATENT DOCUMENTS

| | | | |
|---|---|---|---|
| 8,913,930 | B2 | 12/2014 | Ishii et al. |
| 9,017,239 | B2 | 4/2015 | Ishida et al. |
| 9,436,151 | B2 | 9/2016 | Hayashi et al. |
| 9,482,986 | B2 | 11/2016 | Sakurai et al. |
| 9,921,518 | B2 | 3/2018 | Sakurai et al. |
| 9,952,531 | B2 | 4/2018 | Ishii et al. |
| 9,952,532 | B2 | 4/2018 | Sugiyama et al. |
| 10,082,741 | B2 | 9/2018 | Ishida et al. |
| 10,310,447 | B2 | 6/2019 | Morishita et al. |
| 2011/0135345 | A1 | 6/2011 | Furuya |
| 2013/0130022 | A1 | 5/2013 | Uesugi et al. |
| 2014/0079442 | A1 | 3/2014 | Yamada et al. |
| 2015/0248101 | A1 | 9/2015 | Hayashi et al. |

FOREIGN PATENT DOCUMENTS

| | | |
|---|---|---|
| JP | 2010-122352 | 6/2010 |
| JP | 2011-118132 | 6/2011 |
| JP | 2014-197064 | 10/2014 |

OTHER PUBLICATIONS

U.S. Appl. No. 16/384,043, Ryo Sugiyama, filed Apr. 15, 2019.
U.S. Appl. No. 16/516,790, Kazutoshi Ishida, filed Jul. 19, 2019.

ELECTROPHOTOGRAPHIC MEMBER, PROCESS CARTRIDGE AND ELECTROPHOTOGRAPHIC IMAGE FORMING APPARATUS

BACKGROUND OF THE INVENTION

Field of the Invention

The present disclosure relates to an electrophotographic member incorporated in an apparatus adopting an electrophotographic method. In addition, the present disclosure is directed to a process cartridge and an electrophotographic image forming apparatus.

Description of the Related Art

In the electrophotographic image forming apparatus according to an embodiment (also referred to as "electrophotographic apparatus"), an image carrier is charged by a charging member and an electrostatic latent image is formed by a laser. Then, a developer in a developing container is applied on a developing member by a developer supply member and a developer regulating member, and development is performed by a developer at a contact area between the image carrier and the developing member or an area in which the image carrier and the developing member are close to each other. Thereafter, toner on the image carrier is transferred to recording paper by a transfer unit and fixed by heat and pressure, and the toner remaining on the image carrier is removed by a cleaning blade.

For the electrophotographic members such as the charging member, the developer supply member, and the developer regulating member used in such electrophotographic apparatus, performance which degrades from the initial state as little as possible even by long-term use, that is, high durability is required.

Japanese Patent Application Laid-Open No. 2014-197064 discloses a modified rubber elastic body having a rubber elastic body having rubber elasticity and a surface treated layer composed of a cured product of a photocurable composition impregnated from a surface of the rubber elastic body, and an electrophotographic member using the same. The photocurable composition contains a (meth)acrylic monomer, a photopolymerizable polymer having a silicon group and/or a fluorine-containing group and a (meth) acryloyl group in the molecule, and a photopolymerization initiator. Also, it is disclosed that according to the electrophotographic member, both toner releasability and low friction can be achieved.

SUMMARY OF THE INVENTION

An embodiment of the present disclosure is directed to providing an electrophotographic member having performance which is difficult to degrade from the initial state even by long-term use and excellent durability.

Another embodiment of the present disclosure is directed to providing a method of producing an electrophotographic member having high durability.

Still another embodiment of the present disclosure is directed to providing a process cartridge which contributes to stable formation of high-quality electrophotographic images.

Still another embodiment of the present disclosure is directed to providing an electrophotographic image forming apparatus which can stably form high-quality electrophotographic images.

According to an embodiment of the present disclosure, there is provided an electrophotographic member including: an electroconductive substrate and a single elastic layer as a surface layer, wherein the surface layer includes a binder resin and carbon black dispersed in the binder resin, the binder resin includes a crosslinked urethane resin and a crosslinked acrylic resin, and wherein the surface layer has a first area in which the crosslinked urethane resin and the crosslinked acrylic resin form an interpenetrating polymer network structure, the first area being from an outer surface of the surface layer to a depth of 0.1 μm in the surface layer, and the carbon black has a volatile content of 0.4% or more.

Further, according to another embodiment of the present disclosure, there is provided an electrophotographic member including: an electroconductive substrate and a single elastic layer as a surface layer, wherein the surface layer includes a binder resin and carbon black dispersed in the binder resin, the binder resin includes a crosslinked urethane resin and a crosslinked acrylic resin, the surface layer has a first area in which the crosslinked urethane resin and the crosslinked acrylic resin are included, the first area being from an outer surface of the surface layer to a depth of 0.1 μm in the surface layer, when sampling a first sample from the first area, and a peak top temperature of a thermal chromatogram derived from the crosslinked acrylic resin in the first sample is defined as A1 (° C.) and when obtaining a second sample by decomposing the crosslinked urethane resin in the first sample, and a peak top temperature of a thermal chromatogram derived from the crosslinked acrylic resin in the second sample is defined as A2 (° C.), A1 and A2 satisfy the following relationship represented by the following Equation (1), and the carbon black has a volatile content of 0.4% or more:

$$A1>A2 \quad (1).$$

Further, according to another embodiment of the present disclosure, there is provided a method of producing the electrophotographic member including: forming a resin layer including a crosslinked urethane resin as a binder resin and carbon black having a volatile content of 0.4% or more on an electroconductive substrate, impregnating an outer surface of the resin layer with a liquid acrylic monomer, and curing the impregnated acrylic monomer.

Further, according to still another embodiment of the present disclosure, there is provided a process cartridge configured to be detachably attachable to a main body of the electrophotographic image forming apparatus including the electrophotographic member described above.

Further, according to still another embodiment of the present disclosure, there is provided an electrophotographic image forming apparatus including: an image carrier for carrying an electrostatic latent image, a charging device for primarily charging the image carrier, an exposure device for forming the electrostatic latent image on the primarily charged image carrier, a developing member for forming a toner image by developing the electrostatic latent image by toner, and a transfer device for transferring the toner image to a transfer material, wherein the developing member is the electrophotographic member described above.

Further features of the present disclosure will become apparent from the following description of exemplary embodiments with reference to the attached drawings.

DESCRIPTION OF THE EMBODIMENTS

The present inventors studied a method for improving strength of a rubber elastic body described in Japanese Patent Application Laid-Open No. 2014-197064. According to the study of the present inventors, a method in which after impregnating a surface of a rubber elastic body with an acrylic monomer, the acrylic monomer is cured was considered as an advantageous method for improving strength of the rubber elastic body, while maintaining rubber elasticity of the rubber elastic body. That is, it is considered that the rubber elastic body obtained by the method constitutes an interpenetrating polymer network structure in which an acrylic resin enters into a gap of a crosslinked rubber constituting the rubber elastic body. Hereinafter, the interpenetrating polymer network structure may be referred to as an "IPN structure". Since the crosslinked rubber and the acrylic resin constituting the IPN structure basically does not have a chemical bond, rubber elasticity is not impaired, and on the other hand, it is expected that strength can be improved by entanglement of the crosslinked rubber and the acrylic resin.

Here, in order to improve strength of an outer surface of a urethane resin layer while maintaining flexibility of the urethane resin layer, the present inventors manufactured an electrophotographic member having the IPN structure in a surface area and evaluated it. The surface area is formed by impregnating the urethane resin layer including carbon black as a reinforcing material with the acrylic monomer and then curing the acrylic monomer. As a result, when such electrophotographic member is used as a developing member of an electrophotographic image forming apparatus, sometimes cracks occurred on a surface layer having a surface area by long-term use under a high temperature and high humidity environment.

Therefore, the present inventors repeatedly performed studies to further improve the strength of the surface layer having the surface area in which the IPN structure is constituted by the crosslinked acrylic resin and the crosslinked urethane resin.

As a result, by incorporating carbon black having a volatile content of 0.4% or more (hereinafter, also referred to as "highly volatile CB") in the surface area, mechanical strength of the surface area can be further improved.

The present inventors conjectured the reason that the mechanical strength of the surface area can be improved by incorporating the highly volatile CB in the surface area, as follows.

Figure 5:
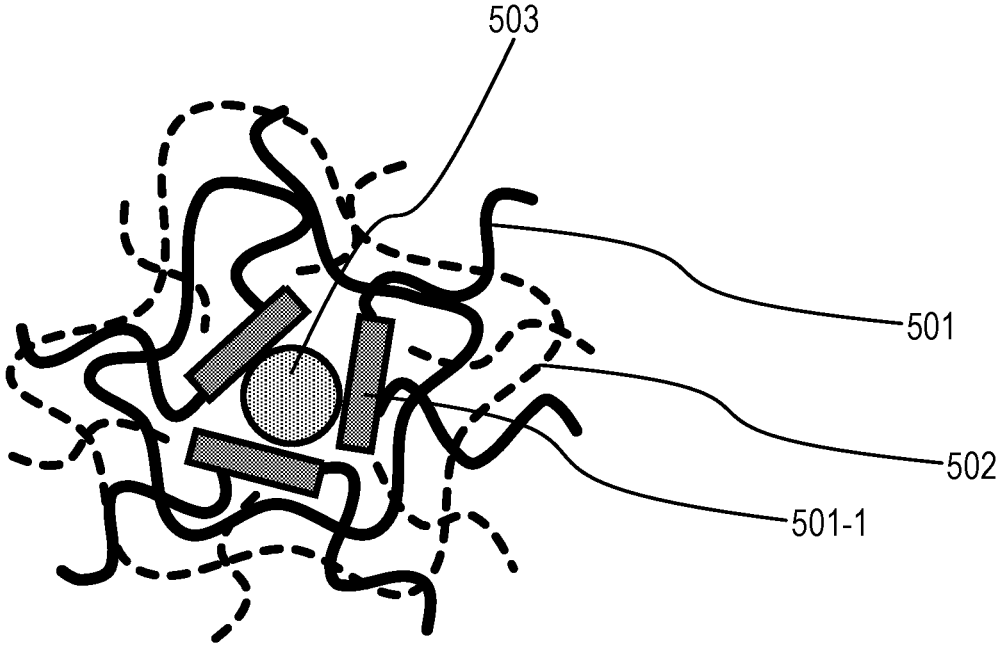
FIG. 5 is a drawing schematically illustrating estimated states of a crosslinked urethane resin, a crosslinked acrylic resin, and carbon black, in a surface area of the developing member according to the present disclosure.

FIG. 5 is a drawing schematically illustrating estimated states of a crosslinked urethane resin, a crosslinked acrylic resin, and carbon black, in the surface area. The crosslinked acrylic resin 502 enters into a gap of a crosslinked structure of the crosslinked urethane resin 501, so that the crosslinked urethane resin 501 and the crosslinked acrylic resin 502 form the IPN structure. Further, the highly volatile CB 503 has many functional groups such as a carboxyl group or a hydroxyl group on the surface. A strong interaction such as a hydrogen bond occurs between the functional group and a urethane bonding portion 501-1 of the crosslinked urethane resin 501, and the highly volatile CB 503 is present near the urethane bonding portion 501-1. Further, a positional relationship between the highly volatile CB 503 and the urethane bonding portion 501-1 is fixed by the crosslinked acrylic resin present around them. Therefore, the interaction between the highly volatile CB 503 and the urethane bonding portion 501-1 is maintained better even under a high temperature environment. As a result, it is considered that the surface area of the surface layer can maintain high strength even under a high temperature environment.

Hereinafter, an electrophotographic member having a roller shape according to an embodiment of the present disclosure (hereinafter, also referred to as an "electrophotographic roller) will be described in detail using the drawings.

Figure 1A:
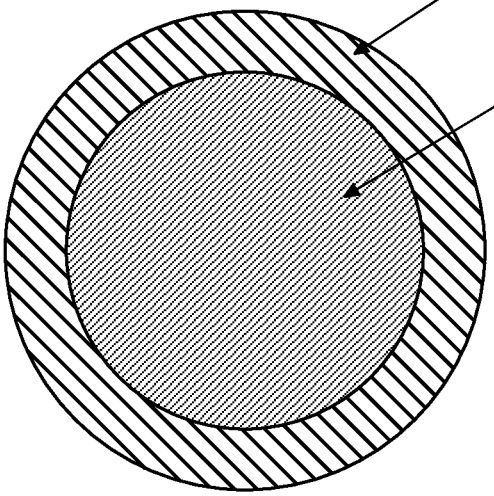
FIGS. 1A and 1B are conceptual views illustrating an example of a developing member according to the present disclosure.
Figure 1B:
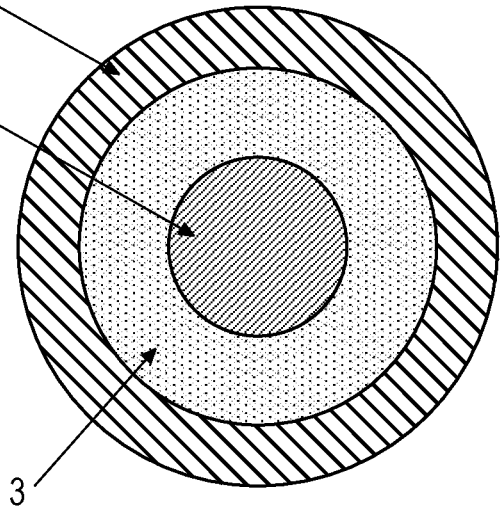

FIG. 1A is a cross-sectional view in a circumferential direction of an electrophotographic roller having an electroconductive substrate 2 and a surface layer 1 on a circumferential surface of the substrate. FIG. 1B is a cross-sectional view in a circumferential direction of an electrophotographic roller having an intermediate layer 3 between the substrate 2 and the surface layer 1.

1. Surface Layer

The surface layer 1 is a single elastic layer and constitutes an outer surface of the electrophotographic roller.

The surface layer includes a binder resin and carbon black dispersed in the binder resin. The binder resin includes a crosslinked urethane resin and a crosslinked acrylic resin, and the surface layer has a first area in which the crosslinked urethane resin and the crosslinked acrylic resin have an interpenetrating polymer network structure, the first area being from the outer surface of the surface layer to a depth of 0.1 μm in the surface layer. Further, the carbon black has a volatile content of 0.4% or more.

1-1. Interpenetrating Polymer Network Structure (IPN Structure)

The interpenetrating polymer network structure (IPN structure) is defined as an entangled structure in which a network structure of two or more polymer compounds is entangled with each other without being covalently bonded.

The IPN structure of the surface layer according to the embodiment is formed by the crosslinked acrylic resin entering into a network of the three-dimensional crosslinked structure of the crosslinked urethane resin. The IPN structure cannot be untangled as long as the molecular chain of the polymer compound forming the network is not cut.

1-1-1. Method of Confirming IPN Structure

The presence of the IPN structure in the surface layer (elastic layer) can be confirmed, for example, by a shift of a glass transition point (Tg) of the polymer constituting the IPN structure.

That is, it is considered that a peak top temperature in a thermal chromatogram corresponding to a thermal decomposition temperature of the crosslinked acrylic resin is shifted to a higher temperature side as compared with a case of being present alone in the IPN structure.

Therefore, it can be confirmed that both of the crosslinked acrylic resin and the crosslinked urethane resin form the IPN structure, by the fact that when the peak top temperatures of the thermal chromatogram of the crosslinked acrylic resin before and after decomposition of the crosslinked urethane resin in the surface layer are compared, the peak top temperature after decomposition is lower than the peak top temperature before decomposition. Here, the thermal chromatogram is a mass spectrum which can be obtained by microsampling thermal decomposition mass spectrometry.

An overview of microsampling mass spectrometry is shown below.

Figure 4:
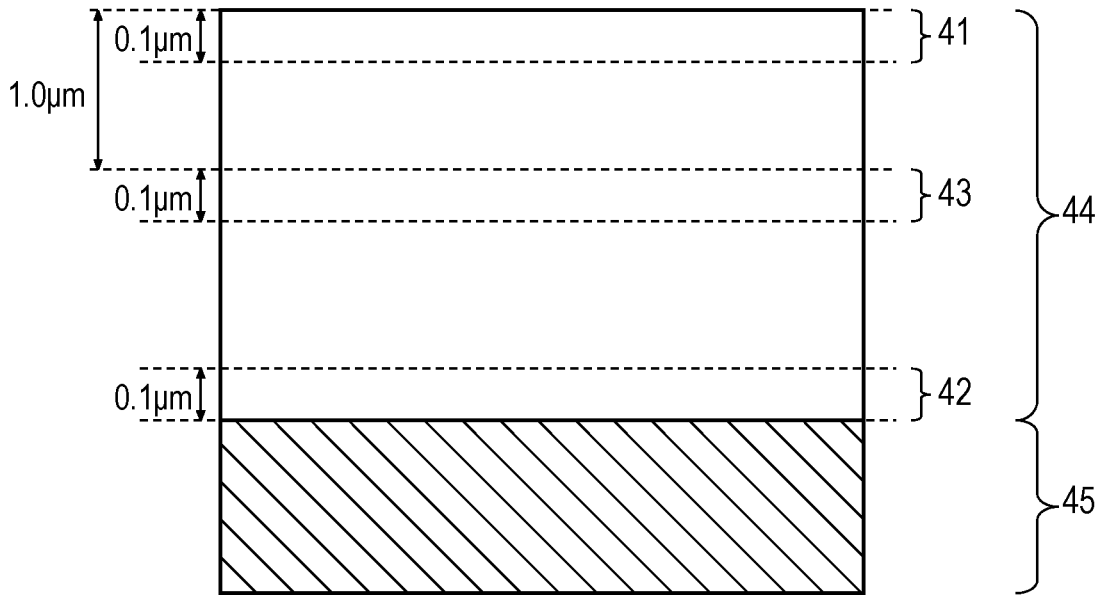
FIG. 4 is a schematic diagram illustrating an example of a cross-section of the developing member according to the present disclosure.

First, the area in which the electrophotographic member is measured is cut into thin pieces with a microtome to prepare a sample. In the present embodiment, as illustrated in FIG. 4, the sample is prepared from three areas called a first area 41, a second area 42, and a third area 43. The first area is an area from an outer surface of the surface layer 44 to a depth of 0.1 μm, the second area is an area having a thickness of 0.1 μm from a back surface of the surface layer 44 (surface facing the electroconductive substrate 45) toward the outer surface, and the third area is an area from the outer surface of the surface layer to a depth of 1.0 μm or more and 1.1 μm or less.

From each area of the surface layer, a flake of a 100 μm square having a thickness of 0.1 μm was manufactured. For measurement, for example, an ion trap mass spectrometer mounted on a gas chromatography mass spectrometer ("Polaris Q", product name, manufactured by Thermo Electron) is used. The sample was fixed to a filament positioned at a tip of a probe and directly inserted into an ionization chamber. Thereafter, the sample was rapidly heated from room temperature to a temperature of 1000° C. at a constant heating rate. The sample which is decomposed and evaporated by heating is ionized by irradiation with an electron beam and detected by a mass spectrometer. At this time, under a condition in which the heating rate is constant, a thermal chromatogram similar to a TG-MS (thermogravimetric-mass simultaneous analysis) method, having a mass spectrum referred to as a total ion chromatogram (TIC), is obtained. Further, since a thermal chromatogram for a fragment of a predetermined mass can be also obtained, the peak temperature of the thermal chromatogram corresponding to the decomposition temperature of the desired molecular structure can be obtained. The peak temperature of the thermal chromatogram has a correlation with a crosslinked structure in a resin structure, and as the crosslinking is denser, the peak temperature shifts to a higher temperature side.

It can be confirmed as follows that the crosslinked acrylic resin forms the interpenetrating polymer network structure with the crosslinked urethane resin. That is, a difference in the peak temperature of the thermal chromatogram of the fragment derived from the crosslinked acrylic resin before and after the crosslinked urethane resin in the composition is decomposed and removed, may be confirmed.

Here, when sampling a first sample from the above-described first area, and the peak top temperature of the thermal chromatogram derived from the crosslinked acrylic resin in the first sample is defined as A1 (° C.). Further, when obtaining a second sample by decomposing the crosslinked urethane resin in the first sample, and the peak top temperature of the thermal chromatogram derived from the crosslinked acrylic resin in the second sample is defined as A2 (° C.). When the interpenetrating polymer network structure is contained in the first area, A1 and A2 satisfies the relationship represented by the following Equation (1):

$$A1>A2 \quad (1).$$

Examples of the method of forming the IPN structure include the following methods i) and ii):

i) a method in which the network structure of a polymer of a first component is formed in advance, and then after the polymer of the first component is swollen with a monomer of a second component using a polymerization initiator, the network structure of a polymer of the second component is formed (this method is also referred to as "a sequential network formation method"), and ii) a method in which a monomer of a first component, a monomer of a second component, and further, each of polymerization initiators, which have different reaction mechanisms, are mixed, and the network structure is formed simultaneously (this method is also referred to as "a simultaneous network formation method").

A method of producing the surface layer (elastic layer) which has the IPN structure in the first area, according to the present embodiment will be described later.

1-2. Binder Resin 1-2-1. Crosslinked Urethane Resin (1) Crosslinked Urethane Resin The crosslinked urethane resin is obtained by reacting a polyol having a hydroxyl group with an isocyanate compound to form a urethane group. Crosslinking referred to herein means that one or both selected from the group consisting of a polyol which is a raw material of a urethane resin and an isocyanate compound have three or more reactive functional groups, thereby having a three-dimensional network structure. Such crosslinked urethane resin has excellent flexibility and high strength.

The urethane resin can be obtained from a polyol and an isocyanate compound, and if necessary, a chain extender. Examples of the polyol which is a raw material of the urethane resin include polyether polyol, polyester polyol, polycarbonate polyol, polyolefin polyol, acrylic polyol, and mixtures thereof. Examples of the isocyanate compound which is a raw material of the urethane resin include the following:

tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetramethyl xylylene diisocyanate (TMXDI), cyclohexane diisocyanate, and mixtures thereof.

Examples of the chain extender as an optional component include ethylene glycol, 1,4-butanediol, difunctional low molecular weight diol such as 3-methylpentanediol, trifunctional low molecular weight triol such as trimethylolpropane, and mixtures thereof. In addition, a prepolymer type isocyanate compound having an isocyanate group at the end which is obtained by reacting the various isocyanate compounds and the various polyols in advance in excess of an isocyanate group relative to a hydroxyl group, may be used. In addition, as the isocyanate compound, materials in which the isocyanate group is blocked by various blocking agents such as methyl ethyl ketone (MEK) oxime, may be used.

Even when any material is used, the urethane resin can be obtained by reacting the polyol and the isocyanate compound by heating. Preferably, when either or both of the polyol and the isocyanate compound have a branched structure and the number of functional groups is 3 or more, the resulting urethane resin becomes a crosslinked urethane resin.

(2) Terminal Structure of Crosslinked Urethane Resin

It is preferred that the IPN structure formed by the crosslinked acrylic resin is formed in the vicinity of the urethane bond of the crosslinked urethane resin. When the crosslinked urethane resin has a terminal structure represented by the following Structural Formula (1), the crosslinked acrylic resin forming the IPN structure can be present at a position close to a urethane bond. That is, when a urethane resin chain constituting the crosslinked urethane resin has a terminal structure containing an organic group represented by the Structural Formula (1) at the end, it is easy to form a space into which the acrylic monomer constituting the crosslinked acrylic resin intrudes, around the terminal structure. Therefore, it is considered that the crosslinked acrylic resin can be present at a position close to the urethane bond contained in the terminal structure. As a result, immobilization of the interaction between the urethane bond and a highly volatile CB is further strengthened and strength of the surface of the surface layer can be further enhanced, by the crosslinked acrylic resin constituting the IPN structure.

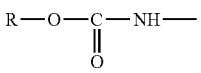

(1)

R is, for example, an organic group which makes the number average molecular weight (Mn) of the portion of the structure represented by Structural Formula (1) 500 or more and 3500 or less, in particular 500 or more and 2500 or less, and the organic group contains an oxyalkylene structure and does not have a cyclic structure.

Specific example of Structural Formula (1) include a structure represented by following Structural Formula (2).

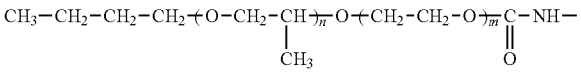

(2)

In Structural Formula (2), m and n are independently of each other an integer of 1 or more which makes the number average molecular weight of the structure represented by Structural Formula (2) 500 or more and 3500 or less.

The structure of Structural Formula (1) can be introduced by the following method.

A polymer compound having one hydroxyl group at the end and having no cyclic structure is added to the crosslinked urethane resin forming material and the terminal isocyanate group of the polyurethane and the hydroxyl group of the compound are reacted by heating to form the urethane bond.

Examples of the polymer compound having one hydroxyl group at the end include a monool having an oxyalkylene structure in the molecule and not containing a cyclic structure. Specific examples thereof include poly(oxyalkylene) glycol monoether of "NEWPOL" (registered trademark) series, manufactured by Sanyo Chemical Industries, Ltd. More specific examples thereof include "NEWPOL 50HB-100" (monool (poly(oxyethylene oxypropylene) glycol monobutyl ether, Mn=510), "NEWPOL LB-1715" (monool (poly(oxypropylene monobutyl ether, Mn=2390), or "NEWPOL 50HB-2000" (monool (poly(oxyethylene oxypropylene) glycol monobutyl ether, Mn=3200).

1-2-2. Crosslinked Acrylic Resin (1) Crosslinked Acrylic Resin

The crosslinked acrylic resin usually has high strength, but when used alone, it may be hard and brittle.

Therefore, when the crosslinked acrylic resin is used in the surface layer of the electrophotographic member as a single film, scratches are likely to occur by scraping by rubbing, due to its brittleness. In addition, due to its hardness, a load on toner tends to increase and filming may be caused. On the other hand, when the crosslinked acrylic resin is introduced as the IPN structure with the crosslinked urethane resin, its crystallinity is broken and hardness and brittleness are hardly expressed.

In addition, by forming the IPN structure with the crosslinked urethane resin containing carbon black having a volatile content of 0.4% or more, a molecular motion of the urethane group at high temperature is limited and an interaction with the carbon black is maintained, whereby high strength can be imparted.

The crosslinked acrylic resin is formed by polymerization of the acrylic monomer. The acrylic monomer referred to herein means not only an acrylic monomer simply but also a methacrylic monomer. That is, the crosslinked acrylic resin is formed by polymerization of either or both of the acrylic monomer and the methacrylic monomer.

In order to form the IPN structure of the crosslinked acrylic resin and the crosslinked urethane resin, the resin layer containing the crosslinked urethane resin and carbon black having a volatile content of 0.4% or more is impregnated with the liquid acrylic monomer and cured, as described above. The kind of acrylic monomer used herein includes a polyfunctional monomer having a plurality of acryloyl groups or methacryloyl groups as a functional group, in order to form a crosslinked structure. On the other hand, when the number of functional groups is 4 or more, viscosity of the acrylic monomer becomes significantly high, so that it is difficult to penetrate into the surface of the resin layer formed of the crosslinked urethane resin, and as a result, it is difficult to form the IPN structure. Therefore, as the acrylic monomer, a monomer having total two or three existing acryloyl and methacryloyl groups contained in one molecule is preferred, and a difunctional acrylic monomer having two existing acryloyl and methacryloyl groups is more preferred.

The molecular weight of the acrylic monomer is preferably in a range of 200 or more and 750 or less. By using the acrylic monomer having the molecular weight within the range, the IPN structure can be easily formed, relative to the network structure of the crosslinked urethane resin, whereby the strength of the surface layer can be effectively improved.

As described above, the acrylic monomer is impregnated into the resin layer containing the crosslinked urethane resin and carbon black. To do so, it is necessary to have an appropriate viscosity. That is, it is difficult to perform impregnation at a high viscosity, and it is difficult to control the impregnated state at a low viscosity. Therefore, it is preferred that the viscosity of the acrylic monomer is 5.0 mPa·s or more and 140 mPa·s or less at 25° C.

That is, by selecting one or two or more acrylic monomers satisfying the above-described ranges of the molecular weight and the viscosity, impregnating the resin layer with the acrylic monomer, and performing polymerization, the IPN structure of the crosslinked urethane resin and the crosslinked acrylic resin can be formed.

Though a polymerization method of the acrylic monomer is not particularly limited, a known method can be used. Specifically, thermal polymerization by heating or photopolymerization such as ultraviolet irradiation can be used.

For each polymerization method, known radical polymerization initiators or ionic polymerization initiators can be used.

Examples of the thermal polymerization initiator in the case of thermal polymerization include peroxides such as 3-hydroxy-1,1-dimethylbutylperoxy neodecanoate, α-cumylperoxy neodecanoate, t-butylperoxy neoheptanoate, t-butylperoxy pivalate, t-amylperoxy normaloctoate, t-butylperoxy 2-ethylhexyl carbonate, dicumyl peroxide, di-t-butyl peroxide, di-t-amyl peroxide, 1,1-di(t-butylperoxy) cyclohexane, and n-butyl-4,4-di(t-butylperoxy) valerate; and azo compounds such as 2,2-azobisbutyronitrile, 2,2-azobis(4-methoxy-2,4-dimethylvaleronitrile), 2,2-azobis(2,4-dimethylvaleronitrile), 2,2-azobis(2-methylbutyronitrile), 1,1-azobis(cyclohexane-1-carbonitrile), 2,2-azobis[2-(2-imidazolin-2-yl) propane], 2,2-azobis[2-methyl-N-(2-hydroxyethyl) propionamide], 2,2-azobis[N-(2-propenyl)-2-methylpropionamide], 2,2-azobis(N-butyl-2-methoxypropionamide), and dimethyl-2,2-azobis (isobutyrate).

Examples of the photopolymerization initiators in the case of photopolymerization by ultraviolet irradiation include 2,2-dimethoxy-1,2-diphenylethan-1-one, 1-hydroxycyclohexyl phenyl ketone, 2-hydroxy-2-methyl-1-phenylpropan-1-one, 1-[4-(2-hydroxyethoxy)-phenyl]-2-hydroxy-2-methyl-1-propan-1-one, 2-hydroxy-1-{4 [4-(2-hydroxy-2-methyl-propionyl)-benzyl]-phenyl}-2-methylpropan-1-one, 2-methyl-1-[4-(methylthio) phenyl]-2-morpholinopropan-1-one, 2-benzyl-2-dimethylamino-1-(4-morpholinophenyl)-butan-1-one, 2-dimethylamino-2-(4-methylbenzyl)-1-(4-morpholin-4-yl-phenyl)-butan-1-one, bis(2,4,6-trimethylbenzoyl)-phenylphosphine oxide, and 2,4,6-trimethylbenzoyl-diphenylphosphine oxide.

These polymerization initiators may be used alone or in combination of two or more.

Further, a blending amount of the polymerization initiator is used at 0.5 parts by mass or more and 10 parts by mass or less, from a viewpoint of efficiently advancing the reaction, when a total amount of a compound for forming a specific resin (for example, a compound having a (meth) acryloyl group) is 100 parts by mass. As an apparatus for heating and an apparatus for ultraviolet irradiation, a known apparatus can be appropriately used. As a light source irradiating an ultraviolet-ray, for example, an LED lamp, a high pressure mercury lamp, a metal halide lamp, a xenon lamp, a low pressure mercury lamp, or the like can be used. A cumulative amount of light required for polymerization can be appropriately adjusted, according to the kind and addition amount of compound and polymerization initiator to be used.

1-3. Carbon Black

As the carbon black according to the present embodiment, carbon black having a volatile content of 0.4% or more, and preferably 0.6% or more is used. The volatile content of the carbon black is measured in accordance with the Japanese Industrial Standard (JIS) K 6221 (1982), "Test method of carbon black for rubber".

The volatile content of the carbon black is a parameter correlating to an amount of functional groups present on the surface of the carbon black. The higher the volatile content, the larger the amount of functional groups present on the surface of the carbon black. Examples of the functional group on the surface of the carbon black usually include a carboxyl group or a hydroxyl group. Therefore, as the carbon black has a higher the volatile content, that is, has more functional groups on the surface, the carbon black can have a higher acidity.

The crosslinked urethane resin has a soft segment and a hard segment; the soft segment is based on the main chain backbone of polyol as a raw material, and the hard segment is one in which urethane bonds in the molecule are aggregated by hydrogen bonding. That is, in the crosslinked urethane resin, there are relatively many urethane bonds in the hard segment.

It is preferred that a coating material for forming the resin layer to be the surface layer includes polyol and polyisocyanate which are raw materials of the crosslinked urethane resin, and carbon black having a volatile content of 0.4% or more. When the resin layer is formed using the coating material, carbon black forms a hydrogen bond with a urethane bond, together with the formation of the crosslinked urethane resin. As a result, the crosslinked urethane resin in the resin layer has a pseudo-crosslinked structure through the carbon black, in addition to the three-dimensional crosslinked structure of the urethane resin itself, thereby further improving the strength of the crosslinked urethane resin.

Further, in the surface layer according to the present embodiment, the IPN structure of the crosslinked urethane resin and the crosslinked acrylic resin is formed in the first area from the outer surface of the surface layer to a depth of 0.1 μm. That is, the crosslinked acrylic resin enters into a gap of the network structure of the crosslinked urethane resin.

This suppresses the molecular mobility of the hard segment of the crosslinked urethane resin. This is considered to occur due to a volume exclusion effect with the presence of the crosslinked acrylic resin and a polarity difference between a backbone structure of the crosslinked acrylic resin and the hard segment of the crosslinked urethane resin.

Therefore, it is difficult to break the hydrogen bond between the urethane bond and the carbon black, even under a high temperature environment. As a result, it is considered that the surface layer according to the present embodiment can maintain high strength, even under a high temperature environment.

Examples of the carbon black having a volatile content of 0.4% or more include a SUNBLACK (registered trademark) series which is carbon black for colors manufactured by Asahi Carbon Co., Ltd. or a series of MITSUBISHI (registered trademark) carbon black for colors manufactured by Mitsubishi Chemical Corporation, which are commercially available.

The content of the carbon black in the surface layer may preferably be 3 parts by mass or more and 50 parts by mass or less, and more preferably be 5 parts by mass or more and 30 parts by mass or less, with respect to 100 parts by mass of the resin component of the surface layer, from a viewpoint of strength and flexibility. Within the range, both excellent flexibility and high strength of the crosslinked urethane resin can be more easily achieved.

The quantification of the carbon black in the surface layer can be performed, for example, by thermogravimetric analysis (TGA) of a sample collected from the surface layer. Specifically, the surface layer collected in the first step is heated to a temperature of 550° C. under a nitrogen atmosphere and maintained for 10 minutes to decompose the resin component. In the second step, cooling is performed to a temperature of 400° C., air is introduced, and further temperature is raised to 800° C. to decompose the carbon black. The content of the carbon black relative to 100 parts by mass of the resin component can be determined from a ratio of a mass loss in the first and second steps.

1-4. Function of Surface Layer

One of the functions of the surface layer is alleviation of mechanical stress applied to toner by a developer carrier. In order to sufficiently exhibit such function, it is preferred that the surface layer is flexible. To do so, it is preferred that there is no IPN structure in the second area having a thickness of 0.1 μm from the surface of the side facing the substrate of the surface layer toward the outer surface. In addition, even in the case that there is the IPN structure, it is preferred that the IPN structure has a low intrusion degree of the crosslinked acrylic resin as compared with the IPN structure in the first area.

Therefore, it is preferred that the first and second areas of the surface layer satisfy the relationship represented by the following Equation (2), and particularly satisfy the relationship represented by the following Equation (3). Here, T1 (° C.) is the peak top temperature of the thermal chromatogram derived from the crosslinked urethane resin measured in a sample sampled from the first area. T2 (° C.) is the peak top temperature of the thermal chromatogram derived from the crosslinked urethane resin measured in a sample sampled from the second area.

$$T1>T2 \quad (2)$$

$$(T1-T2)>1.0(^\circ\ \mathrm{C.}) \quad (3)$$

Further, in order to better exhibit the function of the surface layer described above, it is preferred that the thickness of the surface layer is 2.0 μm or more and 150.0 μm or less. In the surface layer having the thickness, when an area having a thickness of 0.1 μm from the outer surface to a depth of 1.0 μm to 1.1 μm is a third area, it is preferred that there is no IPN structure in the third area adjacent to the first area. In addition, even in the case that there is the IPN structure, it is preferred that the IPN structure has a low intrusion degree of the crosslinked acrylic resin as compared with the IPN structure in the first area.

Therefore, when the peak top temperature of the thermal chromatogram derived from the crosslinked urethane resin, measured in a sample sampled from the third area is defined as T3 (° C.), it is preferred that T1, T2, and T3 satisfy the relationship of Equation (4) and Equation (5).

$$T1>T3 \quad (4)$$

$$|T1-T3|>|T3-T2| \quad (5)$$

The surface layer satisfying the relationship represented by Equation (2) can be also defined as follows, from a viewpoint of hardness. That is, when Martens hardness in the outer surface of the surface layer is defined as H1 ($N/mm^2$) and Martens hardness in the surface of the side facing the substrate of the surface layer is defined as H2 ($N/mm^2$), it is preferred that H1 and H2 satisfy the following Equation (6) and Equation (7).

$$H1>H2 \quad (6)$$

$$H2<1.0(N/mm^2) \quad (7)$$

1-5. Other Components

The surface layer can include a electroconductive material, a crosslinking agent, a plasticizer, a filler, an extender, a vulcanizing agent, a vulcanization aid, a crosslinking aid, an antioxidant, an anti-aging agent, a processing aid, or a leveling agent, to the extent that the function of the surface layer is not hindered, in addition to those described above. Further, when surface roughness is needed in the surface layer, fine particles for imparting roughness to the surface layer can be included. Specifically, fine particles of a polyurethane resin, a polyester resin, a polyether resin, a polyamide resin, an acrylic resin, or a polycarbonate resin can be used. It is preferred that the volume average particle diameter of the fine particles is 1.0 μm or more and 30 μm or less, and it is preferred that the surface roughness (ten-point average roughness) Rzjis formed by the fine particles is 0.1 μm or more and 20 μm or less. Rzjis is a value measured based on JIS B0601(1994).

1-6. Method of Producing Surface Layer

When the electrophotographic member of the present embodiment is produced by a sequential mesh formation method, forming a resin layer including a crosslinked urethane resin as a binder resin and carbon black having a volatile content of 0.4% or more on an electroconductive substrate, impregnating an outer surface of the resin layer with a liquid acrylic monomer, and curing the impregnated acrylic monomer are included. The surface layer according to the present embodiment can be formed by undergoing the above steps.

Though the method of forming the resin layer is not particularly limited, a coating molding method of a liquid coating material is preferred. For example, each material for the resin layer is dispersed and mixed in a solvent to form a coating material, which is coated on an electroconductive substrate, and subjected to solidification by drying or thermal curing, whereby formation is possible.

As a solvent, a polar solvent is preferred from a viewpoint of compatibility with a polyol or isocyanate compound, which is a raw material of the crosslinked urethane. For example, alcohols such as methanol, ethanol, and n-propanol, ketones such as acetone, methyl ethyl ketone and methyl isobutyl ketone, esters such as methyl acetate and ethyl acetate, and the like, and other solvent having good compatibility with materials can be mixed and used alone or in combination of two or more.

Further, a solid content at the time of forming the coating material can be freely adjusted by a mixing amount of the solvent, but is preferably adjusted to 20% by mass or more and 40% by mass or less, from a viewpoint of uniformly dispersing carbon black. For dispersing and mixing, a known dispersion device using beads such as a sand mill, a paint shaker, DYNO-MILL, or PEARL MILL can be used. Further, as the coating method, immersion coating, ring coating, spray coating, or roll coating can be used.

The solidification by drying or curing by heating is not particularly limited as long as crosslinking of the urethane resin proceeds; however, a temperature of 50° C. or more is preferred, and a temperature of 70° C. or more is more preferred.

Next, the resin layer formed as described above is impregnated with a liquid acrylic monomer.

By being impregnated with an impregnating solution which is the liquid acrylic monomer appropriately diluted with various solvents, the surface layer having a more uniform surface composition can be formed.

The solvent can be freely selected from solvents satisfying both affinity to the resin layer and solubility of the acrylic monomer. For example, alcohols such as methanol, ethanol, and n-propanol, ketones such as acetone, methyl ethyl ketone and methyl isobutyl ketone, esters such as methyl acetate and ethyl acetate, and the like, can be used. Further, a polymerization initiator can be appropriately mixed with the impregnating solution. Details of the polymerization initiator will be described later. Though an impregnation method of the impregnating solution is not particularly limited, immersion coating, ring coating, spray coating, or roll coating can be used.

After impregnation treatment is performed with the impregnating solution as such, the acrylic monomer is polymerized and cured, thereby forming a surface layer. Though a curing method is not particularly limited, a known method can be used. Specifically, a method such as thermal curing or ultraviolet irradiation can be used.

By the process, the crosslinked acrylic resin is introduced in a mutually entangled form to the network structure of the crosslinked urethane resin of the resin layer, and the IPN structure can be formed. It is preferred that a film thickness of the thus-obtained surface layer is 2.0 μm or more and 150.0 μm or less, from a viewpoint of film strength and flexibility.

2. Substrate

As the electroconductive substrate 2, a columnar or cylindrical electroconductive substrate can be used. For the purpose of improving adhesion to the intermediate layer or the surface layer provided on the outer circumference, the surface of the substrate may be subjected to known surface treatment or may be provided with an adhesive layer. As a material, the substrate can be composed of the following electroconductive materials:

metals or alloys such as aluminum, a copper alloy, or stainless steel;

iron plated with chromium or nickel; and a synthetic resin having electroconductivity.

3. Intermediate Layer

It is preferred that the intermediate layer 3 is formed of a molded body of a rubber material. Examples of the rubber material include the following. An ethylene-propylene-diene copolymerization rubber (EPDM), an acrylonitrile-butadiene rubber (NBR), a chloroprene rubber (CR), a natural rubber (NR), an isoprene rubber (IR), a styrene-butadiene rubber (SBR), a fluorine rubber, a silicone rubber, an epichlorohydrin rubber, an NBR hydride, and a urethane rubber. These can be used alone or in combination of two or more. Among them, silicone rubber which hardly causes a compression permanent strain in the electroconductive intermediate layer even when other members (toner regulating member or the like) is in contact for a long period of time, is preferred. Specific examples of the silicone rubber include a cured product of addition-curable liquid silicone rubber.

The intermediate layer can be an electroconductive intermediate layer by mixing the rubber material with an electroconductivity imparting agent such as an electron conductive material or an ion conductive material. A volume resistivity of the electroconductive intermediate layer is adjusted to preferably $10^3$ Ωcm or more and $10^{11}$ Ωcm or less, and more preferably $10^4$ Ωcm or more and $10^{10}$ Ωcm or less.

Examples of the electron conductive material include the following materials. Electroconductive carbon, carbon for rubber, electroconductive carbon black such as carbon for color (ink), and metal and metal oxides thereof can be used. For example, highly electroconductive carbon such as ketjen black EC and acetylene black; carbon for rubber such as SAF, ISAF, HAF, FEF, GPF, SRF, FT, and MT; carbon for color (ink) obtained by oxidizing carbon black powder; metals such as copper, silver, and germanium and metal oxides thereof. Among them, electroconductive carbon black (electroconductive carbon, carbon for rubber, carbon for color (ink)) is preferred, since it is easy to control electroconductivity with a small amount.

Examples of the ion conductive material include the following materials: inorganic ion electroconductive materials such as sodium perchlorate, lithium perchlorate, calcium perchlorate, and lithium chloride; and organic ion electroconductive materials such as modified aliphatic dimethyl ammonium ethosulfate and stearyl ammonium acetate.

The electroconductivity imparting agent is used in an amount necessary to adjust the intermediate layer to the appropriate volume resistivity as described above, but used in a range of 0.5 parts by mass or more and 50 parts by mass or less, with respect to 100 parts by mass of the rubber material constituting the intermediate layer.

Further, the intermediate layer can include various additives such as a plasticizer, a filler, an extender, a vulcanizing agent, a vulcanizing aid, a crosslinking aid, a curing inhibitor, an antioxidant, an antiaging agent, and a processing aid, if necessary. Examples of the filler include silica, quartz powder, calcium carbonate, and the like. The optional component is blended in an amount range which does not hinder the function of the intermediate layer.

The intermediate layer has elasticity required for a developing member, and has an Asker C hardness of preferably 20 degrees or more and 100 degrees or less and a thickness of preferably 0.3 mm or more and 6.0 mm or less.

Mixing of each material for the intermediate layer is performed using a dynamic mixing device such as a single-screw continuous kneader, a twin-screw continuous kneader, a two-roll, a kneader mixer, or a trimix, or a static mixing device such as a static mixer.

Though a method of forming the intermediate layer on the substrate is not particularly limited, examples thereof include a die molding method, an extrusion molding method, an injection molding method, and a coating molding method. In the die molding method, for example, first, a piece for holding a shaft core in the mold is fixed to both ends of a cylindrical mold, and an inlet is formed in the piece. Then, the shaft core is disposed in the mold, materials for the intermediate layer are injected from the inlet, the mold is heated to a temperature at which the materials are cured, and the material is released from the mold. In the extrusion molding method, for example, the materials of the shaft core and the intermediate layer are co-extruded using a crosshead extruder and the material is cured to form the intermediate layer around the shaft core.

The surface of the intermediate layer can be modified by a surface modification method of surface polishing, a corona treatment, a flame treatment, or an excimer treatment, for improving adhesion to the surface layer.

4. Electrophotographic Process Cartridge and Electrophotographic Image Forming Apparatus The electrophotographic image forming apparatus according to the present embodiment has, for example, the following configuration:

- an image carrier for carrying an electrostatic latent image;
- a charging device for primarily charging the image carrier;
- an exposure device for forming the electrostatic latent image on the primarily charged image carrier;
- a developing device for developing the electrostatic latent image by toner to form a toner image; and
- a transfer device for transferring the toner image to a transfer material.

Figure 2:
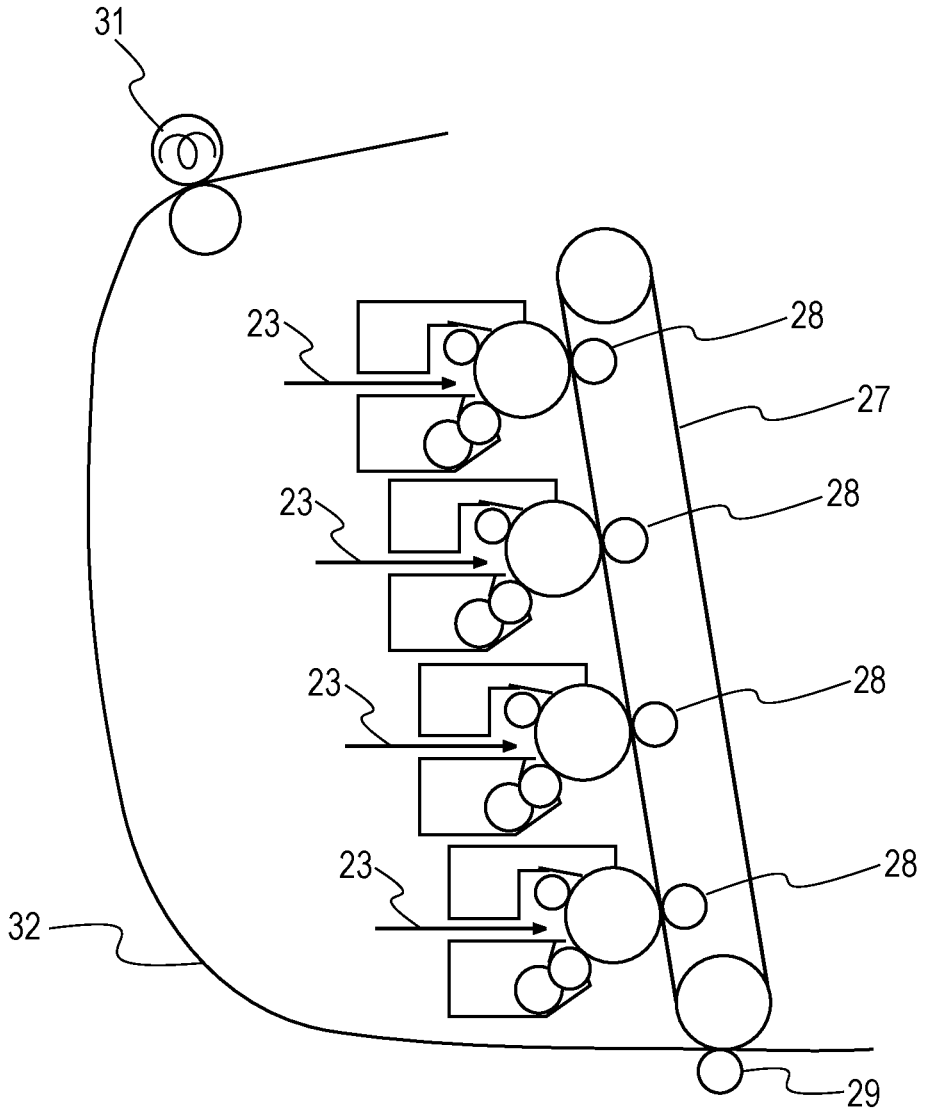
FIG. 2 is a schematic configuration diagram illustrating an example of an electrophotographic image forming apparatus according to the present disclosure.

FIG. 2 is a cross-sectional view illustrating an outline of the electrophotographic image forming apparatus according to the present embodiment.

Figure 3:
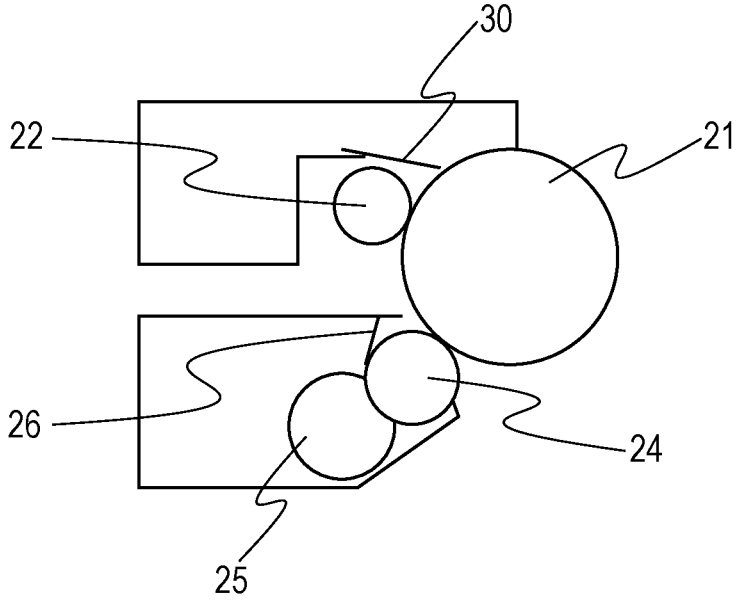
FIG. 3 is a schematic configuration diagram illustrating an example of a process cartridge according to the present disclosure.

FIG. 3 is an enlarged cross-sectional view of the process cartridge mounted on the electrophotographic image forming apparatus of FIG. 2. The process cartridge houses the image carrier 21 such as a photosensitive drum, a charging device provided with a charging member 22, a developing device provided with a developing member 24, and a cleaning device provided with a cleaning member 30. The process cartridge is configured to be detachably attachable to the main body of the electrophotographic image forming apparatus of FIG. 2.

The image carrier 21 is uniformly charged (primarily charged) by the charging member 22 connected to a bias power supply (not illustrated). The charging potential of the image carrier 21 at this time is −800 V or more and −400 V or less. Next, the image carrier 21 is irradiated with exposure light 23 for writing the electrostatic latent image by the exposure device (not illustrated), thereby forming the electrostatic latent image on the surface. As the exposure light 23, either LED light or laser light can be used. The surface potential of the image carrier 21 of the exposed portion is −200 V or more and −100 V or less.

Next, the toner negatively charged by the developing member 24 is imparted (developed) to the electrostatic latent image, the toner image is formed on the image carrier 21, and the electrostatic latent image is converted to a visible image. At this time, a voltage of −500 V or more and −300 V or less is applied to the developing member 24 by the bias power supply (not illustrated). The developing member 24 is brought into contact with the image carrier 21 with a nip width of 0.5 mm or more and 3 mm or less. In the process cartridge of the present embodiment, the toner supply roller 25 is in contact with the developing member 24 in the state of being rotatable, on the upstream of the rotation of the developing member 24 with respect to a contact portion between a developing blade 26 as the toner regulating member and the developing member 24.

The toner image developed on the image carrier 21 is primarily transferred to an intermediate transfer belt 27. A primary transfer member 28 is in contact with a back surface of the intermediate transfer belt 27, and a voltage of +100 V or more and +1500 V or less is applied to the primary transfer member 28, thereby primarily transferring the negative toner image from the image carrier 21 to the intermediate transfer belt 27. The primary transfer member 28 may have a roller shape or a blade shape.

When the electrophotographic image forming apparatus is a full color image forming apparatus, each of the steps of charging, exposure, development, and primary transfer is performed for each of the colors of yellow, cyan, magenta, and black. Therefore, in the electrophotographic image forming apparatus illustrated in FIG. 2, four process cartridges in total, each housing the toner for each color are mounted in the state of being detachably attachable to the main body of the electrophotographic image forming apparatus. Each of the steps of charging, exposure, development, and primary transfer is sequentially performed with a predetermined time difference, and a state in which four color toner images for expressing a full color image are superimposed on the intermediate transfer belt 27, is produced.

The toner image on the intermediate transfer belt 27 is conveyed to a position facing a secondary transfer member 29, with the rotation of the intermediate transfer belt 27. The recording paper is conveyed along a recording paper conveyance route 32 at a predetermined timing between the intermediate transfer belt 27 and the secondary transfer member 29, and the secondary transfer bias is applied to the secondary transfer member 29, thereby transferring the toner image on the intermediate transfer belt 27 to the recording paper. At this time, the bias voltage applied to the secondary transfer member 29 is +1000 V or more and +4000 V or less. The recording paper on which the toner image has been transferred by the secondary transfer member 29 is conveyed to a fixing device 31 by a recording paper conveyance route 32. After the toner image on the recording paper is melted and fixed on the recording paper in the fixing device 31, the recording paper is discharged to the outside of the electrophotographic image forming apparatus, thereby completing a printing operation.

The toner which is not transferred from the image carrier 21 to the intermediate transfer belt 27 and remains on the image carrier 21 is scraped off by a cleaning member 30 for cleaning the surface of the image carrier 21, thereby cleaning the surface of the image carrier 21.

According to an embodiment of the present disclosure, an electrophotographic member having performance which is difficult to degrade from the initial state even by long-term use and excellent durability, can be obtained. According to another embodiment of the present disclosure, a method of producing an electrophotographic member having high durability can be obtained. According to still another embodiment of the present disclosure, a process cartridge which contributes to stable formation of high-quality electrophotographic images can be obtained. According to still another embodiment of the present disclosure, an electrophotographic image forming apparatus which can stably form high-quality electrophotographic images can be obtained.

EXAMPLES

Hereinafter, the present disclosure will be described in more detail, with reference to specific examples, using a developing roller as an example. The technical scope of the present disclosure as the electrophotographic member is not limited thereto.

Example 1

[1. Manufacture of Electroconductive Substrate]

A primer (product name: DY35-051, manufactured by Dow Corning Toray Co., Ltd.) was applied to a SUS304 core metal having an outer diameter of 6 mm and a length of 264 mm, and heated to a temperature of 150° C. for 20 minutes. The core metal was placed concentrically in a cylindrical mold having an inner diameter of 11.5 mm.

As the material of the intermediate layer, an addition type silicone rubber composition in which the materials shown in the following Table 1 were mixed by Trimix (product name: TX-15, manufactured by INOUE MFG., INC.) was injected into a mold heated to a temperature of 115° C. After the injection of the material, the material was molded by heating at a temperature of 120° C. for 10 minutes, and released from the mold after cooling down to room temperature, thereby obtaining an elastic roller having an intermediate layer having a thickness of 2.71 mm formed on the outer circumference of the electroconductive substrate.

TABLE 1

| Material | Parts by mass |
|---|---|
| Liquid dimethylpolysiloxane having two or more silicon atom-bonded alkenyl groups in one molecule (product name: SF3000E, viscosity of 10000 cP, vinyl group equivalent of 0.05 mmol/g, manufactured by KCC Corporation) | 100 |
| Platinum-based catalyst (product name: SIP6832.2, manufactured by GELEST, INC.) | 0.048 |
| Dimethylpolysiloxane having two or more silicon atom-bonded hydrogen atoms in one molecule (product name: SP6000P, Si—H group equivalent of 15.5 mmol/g. manufactured by KCC Corporation) | 0.5 |
| Carbon black (product name: TOKABLACK #7360SB, manufactured by TOKAI CARBON CO., LTD.) | 6 |

[Formation of Surface Layer]

In formation of the surface layer, first, a resin layer is formed. As the materials of the resin layer, materials other than the roughness-forming particles in the tables in the following Table 2 were stirred and mixed. Thereafter, the materials were dissolved in methyl ethyl ketone (manufactured by KISHIDA CHEMICAL Co., Ltd.) so that the solid content concentration is 30% by mass, mixed, and uniformly dispersed with a sand mill. To this mixed solution, methyl ethyl ketone was added to adjust the solid content concentration to 25% by mass, to which the roughness-forming particles in Table 2 were added, and stirred and dispersed with a ball mill, thereby obtaining a coating material 1 for a resin layer. The elastic roller was immersed in the coating material to be coated, so that the thickness of the resin layer was about 15 μm. Thereafter, heating was performed at a temperature of 130° C. for 60 minutes and the coating film was dried and cured to form the resin layer.

TABLE 2

| Material | Parts by mass |
|---|---|
| Polyetherpolyol (product name: PTGL1000, manufactured by HODOGAYA CHEMICAL CO., LTD.) | 100 |
| Polymeric MDI (product name: MR-400, manufactured by TOSOH CORPORATION) | 37.2 |
| Carbon black (product name: SUNBLACK X15, manufactured by Asahi Carbon Co., Ltd.) | 29.3 |
| Polyethermonool (product name: NEWPOL 50HB100, manufactured by Sanyo Chemical Industries, Ltd.) | 3 |
| Roughness-forming particles (product name: DAIMICBEAZ UCN-5150, manufactured by Dainichiseika Color & Chemicals Mfg. Co., Ltd.) | 17.8 |

Subsequently, impregnation and a curing treatment of an acrylic monomer were carried out by the following method.

As the materials of an impregnating solution for impregnation treatment, materials shown in the following Table 3 were dissolved and mixed. The elastic roller on which the resin layer was formed was treated by immersion for 2 seconds in the impregnating solution to be impregnated with the acrylic monomer component. Thereafter, air drying was performed at a normal temperature for 30 minutes, and drying was performed at 90° C. for 1 hour, thereby evaporating the solvent. An ultraviolet ray was irradiated so that a cumulative amount of light is 15000 mJ/cm$^2$ while the dried elastic roller is rotated, thereby curing the acrylic monomer to form the surface layer. As the ultraviolet irradiation device, a high pressure mercury lamp (product name: handy type UV curing device, manufactured by Mario network) was used.

TABLE 3

| Material | Parts by mass |
|---|---|
| Difunctional acrylic monomer (product name: EBECRYL145, manufactured by DAICEL-ALLNEX LTD.) | 5 |
| Photopolymerization initiator (product name: IRGACURE184, manufactured by BASF) | 0.25 |
| Solvent (product name: methyl ethyl ketone, manufactured by KISHIDA CHEMICAL Co., Ltd.) | 100 |

For the resulting developing roller, the following evaluation was performed.

[Evaluation method]

<Measurement of T1, T2, T3, A1, and A2>

By the microsampling mass spectroscopy, thermal chromatograms of a first area from the outer surface of the developing roller to a depth of 0.1 μm, a second area having a thickness of 0.1 μm from the back surface of the surface layer toward the surface, and a third area from the surface to a depth of 1.0 μm or more and 1.1 μm or less were obtained. From the resulting thermal chromatograms, the peak top temperatures, T1, T2, and T3 of the thermal chromatograms derived from the crosslinked urethane resin in each of the first, second, and third areas, were determined. Further, the peak top temperature A1 of the thermal chromatogram derived from the crosslinked acrylic resin in the first area was obtained. Further, the peak top temperature A2 of the thermal chromatogram derived from the crosslinked acrylic resin measured in the second sample obtained by decomposing the crosslinked urethane resin containing the sample sampled from the first area was obtained.

The samples of each area were collected using a microsampling method by FIB-SEM (product name: NVision40, manufactured by SII NanoTechnology Inc.).

Specifically, first, a cut was made from the surface of the developing roller toward the substrate using a razor, and a rubber piece in a state in which the cross sections of the surface layer and the intermediate layer were exposed, was cut out. The rubber piece was placed on a document table of the SEM so that the roller cross-section was on the upper surface, and the sampling probe was fixed at a position corresponding to the roller surface of the rubber piece. Further, the sample in the first area was collected by performing cutting treatment with FIB at a position corresponding to 0.1 μm inside from the surface corresponding to the roller surface.

For the second area, cutting treatment was performed by FIB at a position of 1.0 μm toward the surface side from the interface between the back surface of the surface layer and the intermediate layer. The sampled probe was fixed to the resulting cut surface, and the sample of the second area was collected by performing cutting treatment with FIB at a position corresponding to 1 μm inside from the cut surface.

Further, in the third area, the third area was exposed by performing cutting treatment by FIB at a position corresponding to 1.0 μm inside from the surface corresponding to the roller surface in the same rubber piece as described above. The sampled probe was fixed to the exposed surface, and the sample of the third area was collected by performing cutting treatment with FIB at a position corresponding to 0.1 μm inside from the exposed surface.

In all cutting treatments, the acceleration voltage of FIB was 30 kV and the beam current was 27 mA.

<Pyridine Decomposition Method>

A pyridine decomposition method was a method of selectively decomposing a urethane bond. In the sample having the IPN structure of the crosslinked acrylic resin and the crosslinked urethane resin, the pyridine decomposition method was performed, thereby obtaining the crosslinked acrylic resin after removing the structure derived from the crosslinked urethane resin. From the resulting crosslinked acrylic resin, the change in peak temperature of the thermal chromatogram due to the presence or absence of the IPN structure can be grasped. As the pyridine decomposition method, specifically the following method was carried out.

A microtome was used to cut out a sample at a thickness of 0.1 μm from the surface of the developing roller to collect a portion of 500 mg. 0.5 ml of a mixed solution of pyridine (manufactured by Wako Pure Chemical Industries, Ltd.) and water at 3:1 was added to the resulting sample, and decomposition was carried out at 130° C. for 15 hours, in a stainless steel jacketed fluorine resin ("Teflon" (registered trademark)) closed container. The resulting decomposition product was treated under reduced pressure to remove pyridine. The above-described microsampling mass analysis was performed using the thus-obtained sample to obtain the value of A2.

<Martens Hardness Measurement>

The surface layer of the developing roller was peeled off, and for the resulting film of the surface layer, Martens hardness was measured on the surface side which is the surface of the developing roller and the back surface side facing the substrate. In the case of the developing roller having an intermediate layer, the surface layer was peeled off using a microtome. First, a rubber piece including a surface layer and an intermediate layer was cut out from the surface of the developing roller into a size of a square of 5 mm and a thickness of 2 mm using a razor. The cross-section of the rubber piece was observed at a magnification of 1000 times, using a digital microscope (product name: VHX-5000, manufactured by KEYENCE CORPORATION). For each of the cross-sectional observation images, a thickness of the surface layer was measured at 10 points, and the thickness of the surface layer was calculated by an arithmetic average of measurement data of a total of 30 points. The rubber piece was placed on the microtome, a cutting operation was performed at points inside the length of the thickness of the surface layer from the surface side of the surface layer, and the film of the surface layer was collected.

The film of the resulting surface layer was fixed to a slide glass, aged under an environment of a temperature of 25° C. and a relative humidity of 55% for 1 hour, and the Martens hardness was measured in the same environment. The measurement position was selected as a smooth point by observing the film surface. In addition, when the microparticles for imparting roughness to the surface layer were contained in the surface layer, measurement was performed by avoiding a convex portion of microparticles. The measurement was performed at 20 points per one sample, and for the value obtained by arithmetically averaging the resulting values, the value on the surface side was H1 and the value on the back surface side was H2. In addition, in the present Example, measurement was performed using FISCHERSCOPE (registered trademark) HM2000XYp, manufactured by FISCHER INSTRUMENTS K.K. The measurement condition was holding for 5 seconds with a maximum load of 0.1 mN.

<Measurement of Volatile Content of Carbon Black>

To a flask equipped with dimroth condenser, 10 parts by mass of the surface layer peeled off from the developing roller 1, 100 parts by mass of diethanolamine (manufactured by Tokyo Chemical Industry Co., Ltd.) as a decomposing agent, and 0.5 parts by mass of pure water were added, and heated to reflux at 160° C. for 20 hours with stirring. To the solution after the reaction, 25 parts by mass of methyl ethyl ketone was added and centrifugation was performed. Further, the reactant was washed twice with 80 parts by mass of methyl ethyl ketone, centrifuged, and then dried under reduced pressure, thereby obtaining carbon black contained in the surface layer. 1.5 g of the thus-obtained carbon black was recovered, and the volatile content of the carbon black was measured in accordance with JIS K6221 (1982), "Test method of carbon black for rubber". Specifically, carbon black was put in a crucible, heated to 950° C. for 7 minutes, and mass was measured after air cooling to calculate a weight loss. The weight loss relative to the original mass was represented as mass, which was the volatile content of the sample.

<Durability Evaluation>

The developing roller 1 was mounted on the process cartridge for the following color laser printer, the color laser printer (product name: HP Color LaserJet Enterprise M652dn, manufactured by HP) was used to evaluate the scratch condition and the filming condition by scraping of the developing roller surface. The evaluation results are shown in the following Table 6. For the evaluation, a cyan cartridge (product name: HP 656X High Yield Cyan Original LaserJet Toner Cartridge, manufactured by HP) for the color laser printer was used. The evaluation procedure is as follows.

The cyan cartridge was allowed to stand for 16 hours under a high temperature and high humidity environment of a temperature of 30° C. and a relative humidity of 95%, and then a low print image of a printing rate of 0.2% was continuously output on a recording paper under the same environment. After printing of 200,000 sheets was completed, the developing roller 1 was removed from the process cartridge, the roller surface was air-blown to remove toner coated on the surface, the roller surface was visually observed, and the surface condition was evaluated according to the following evaluation criteria.

Evaluation criteria

Rank "A": unable to visually confirm scratches by scraping on the surface.

Rank "B": able to confirm scratches, but the largest scratch is less than 1 mm in length.

Rank "C": able to confirm occurrence of scratches of 1 mm or more.

The roller surface was observed using a 20× objective lens, with a laser microscope (product name: VK-8700, manufactured by Keyence Corporation), and the state of filming was evaluated according to the following evaluation criteria.

Rank "A": an area of fixed toner relative to the total surface area of the roller being 5% or less.

Rank "B": an area of fixed toner relative to the total surface area of the roller being more than 5% and 15% or less.

Rank "C": an area of fixed toner relative to the total surface area of the roller being more than 15%.

The above evaluation results are shown in the following Table 7.

Examples 2, 4, 5, and 12 to 17

The coating material for the resin layer was prepared with the materials shown in Table 4, the impregnating solution was prepared with the materials shown in Table 5, and the developing roller was manufactured with the combination shown in Table 6, in the same manner as in Example 1, and evaluation was performed in the same manner as in Example 1.

Example 3

A developing roller was manufactured in the same manner as in Example 1, except that the time for immersion in the impregnating solution was changed to 10 minutes, and was evaluated in the same manner as in Example 1.

Example 6

A developing roller was manufactured in the same manner as in Example 1, except that the film thickness of the resin layer was changed to 2 μm by setting the solid content concentration before mixing the roughness-forming particles of the coating material for the resin layer to 15% by mass, and was evaluated in the same manner as in Example 1.

Example 7

A developing roller was manufactured in the same manner as in Example 1, except that the film thickness of the resin layer was changed to 150 μm by setting the solid content concentration before mixing the roughness-forming particles of the coating material for the resin layer to 40% by mass, and was evaluated in the same manner as in Example 1.

Example 8

A developing roller was manufactured in the same manner as in Example 1, except that the film thickness of the resin layer was changed to 1.4 μm by setting the solid content concentration before mixing the roughness-forming particles of the coating material for the resin layer to 13% by mass, and was evaluated in the same manner as in Example 1.

Example 9

A developing roller was manufactured in the same manner as in Example 1, except that the film thickness of the resin layer was changed to 160 μm by setting the solid content concentration before mixing the roughness-forming particles of the coating material for the resin layer to 42% by mass, and was evaluated in the same manner as in Example 1.

Examples 10 and 11

Developing rollers were manufactured in the same manner as in Example 1, except that the time for immersion in the impregnating solution was changed to 1 minute or 3 minutes, and were evaluated in the same manner as in Example 1.

Comparative Examples 1, 4, and 6

Developing rollers were manufactured by preparing the coating materials for the resin layer with the materials shown in Table 4, in the same manner as in Example 1, except that impregnation and curing treatments of the acrylic monomer were not performed, and were evaluated in the same manner as in Example 1.

Comparative Examples 2 and 3

The coating materials for the resin layer were prepared with the materials shown in Table 4, the impregnating solutions were prepared with the materials shown in Table 5, and the developing roller were manufactured with the combination shown in Table 6, in the same manner as in Example 1, and evaluation were performed in the same manner as in Example 1.

Comparative Example 5

In a 100 ml reaction flask, 1.66 g (0.36 mmol) of acrylate modified silicone oil (product name: X-22-174DX, manufactured by Shin-Etsu Chemical Co., Ltd.), 5.61 g (13 mmol) of 2-(perfluorohexyl)ethylacrylate (product name: R-1620, manufactured by DAIKIN INDUSTRIES, Ltd.), 1.69 g (13 mmol) of 2-hydroxyethyl methacrylate (manufactured by Tokyo Chemical Industry Co., Ltd.), 7.37 g (73.64 mmol) of methyl methacrylate (manufactured by JUNSEI CHEMICAL CO., LTD.), 1.24 g (4 mmol) of dimethyl 1,1'-azobis (1-cyclohexane carboxylate) (product name: VE-73, manufactured by FUJIFILM Wako Pure Chemical Corporation), and 75 g of methyl ethyl ketone (MEK) were mixed, and bubbled by nitrogen for 5 minutes with stirring. Thereafter, the reactant was polymerized at an internal solution temperature of 75° C. for 7 hours to produce a copolymer.

Then, to the reaction flask, 2.02 g (13 mmol) of 2-isocyanatoethyl methacrylate (product name: Karenz MOI, manufactured by Showa Denko K. K.) and 0.001 g of bismuth tris (2-ethylhexanoate) (manufactured by FUJIFILM Wako Pure Chemical Corporation) were added and then stirred at an internal solution temperature of 75° C. for 10 hours, and the hydroxyl group of the polymerization unit based on 2-hydroxyethyl methacrylate in the copolymer and the isocyanate group of 2-isocyanatoethyl methacrylate were reacted, thereby obtaining a solution containing a photopolymerizable polymer A.

The coating material for the resin layer was prepared with the materials shown in Table 4, the impregnating solution was prepared with the materials shown in Table 5, and the developing roller was manufactured with the combination shown in Table 6, in the same manner as in Example 1, except that the solution was used as the material of the impregnating agent. The resulting developing roller was evaluated in the same manner as in Example 1. The evaluation results are shown in the following Table 7.

| | | Coating material for resin layer | | | | | | | | | | | |
|---|---|---|---|---|---|---|---|---|---|---|---|---|---|
| Classification | Material name | 1 | 2 | 3 | 4 | 5 | 6 | 7 | 8 | 9 | 10 | 11 | 12 |
| Polyol | PTGL1000 | 100 | 100 | — | — | 100 | 100 | 100 | — | 100 | — | 100 | 100 |
| | PTMG1000 | — | — | 100 | | — | — | — | — | — | — | — | — |
| | PTMG650 | — | — | — | 100 | — | — | — | — | — | — | — | — |
| | 1,4-butanediol | — | — | — | — | — | — | — | — | — | 100 | — | — |
| Isocyanate | MR-400 | 37.2 | 37.2 | 60.8 | 37.2 | 37.2 | 37.2 | 37.2 | — | 37.2 | 370.7 | 37.2 | 37.2 |
| Thermoplastic urethane resin | ME-8115LP | — | — | — | — | — | — | — | 100 | — | — | — | — |
| Carbon black | SUNBLACK X15 | 29.3 | — | 31.5 | 29.3 | 29.3 | 29.3 | 29.3 | 7.5 | — | 60.9 | 29.3 | 29.3 |
| | #5 | — | 29.3 | — | — | — | — | — | — | — | — | — | — |
| | #4000 | — | — | — | — | — | — | — | — | 29.3 | — | — | — |
| Monool component | 50HB-100 | 3 | 3 | 3 | 3 | — | — | — | 0.9 | 3 | 3 | 3 | 3 |
| | LB-1715 | — | — | — | — | 3 | — | — | — | — | — | — | — |
| | 50HB-2000 | — | — | — | — | — | — | — | — | — | — | — | — |

-continued

| Classification | Material name | Coating material for resin layer | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Roughness-forming particles | UCN-5150 | 17.8 | 17.8 | 18.9 | 17.8 | 17.8 | 17.8 | 17.8 | 9.6 | 17.8 | 38.5 | 17.8 | 17.8 |
| Others | MX-150 | — | — | — | — | — | — | — | — | — | — | — | — |
| | LCB-19 | — | — | — | — | — | — | — | — | — | — | — | — |

The numbers in the table represent the blending amounts of each material in parts by mass.

The materials listed in the table are as follows.

"PTGL 1000": product name; polyol manufactured by HODOGAYA CHEMICAL CO., LTD.

"PTMG 1000": product name; polyol manufactured by Mitsubishi Chemical Corporation.

"PTMG 650": product name; polyol manufactured by Mitsubishi Chemical Corporation.

1,4-butandiol: diol manufactured by Mitsubishi Chemical Corporation;

"MR-400" ("Millionate MR-400": product name, an isocyanate compound manufactured by TOSOH CORPORATION (polymeric MDI).

"ME-8115LP" ("RESAMINE ME-8115LP"); product name; a thermoplastic polyurethane manufactured by Dainichiseika Color & Chemicals Mfg. Co., Ltd.

"SUNBLACK X15" (product name; carbon black manufactured by Asahi Carbon Co., Ltd. (volatile content: 2.1%).

"#5": (product name; carbon black manufactured by Mitsubishi Chemical Corporation (volatile content: 0.4%)).

"#4000": (product name; carbon black manufactured by Mitsubishi Chemical Corporation (volatile content: 0.3%)).

"50HB-100" (NEWPOL 50HB-100): product name; monool (poly(oxyethyleneoxypropylene)glycol monobutylether manufactured by Sanyo Chemical Industries, Ltd., molecular weight Mn=510).

"LB-1715" (NEWPOL LB-1715): product name; monool (polyoxypropylene monobutylether, manufactured by Sanyo Chemical Industries, Ltd., molecular weight Mn=2390).

"50HB-2000" (NEWPOL 50HB-2000): product name; monool (poly(oxyethyleneoxypropylene)glycol monobutylether manufactured by Sanyo Chemical Industries, Ltd., molecular weight Mn=3200).

"UCN-5150" ("DAIMICBEAZ UCN-5150"): product name; crosslinked urethane resin particles manufactured by Dainichiseika Color & Chemicals Mfg. Co., Ltd.)

"MX-150" (Chemisnow MX-150): product name; crosslinked acryl particles manufactured by Soken Chemical & Engineering Co., Ltd.

"LCB-19": product name; a chain acryl resin manufactured by Mitsubishi Chemical Corporation.

TABLE 5

| Classification | Material name | Impregnating solution | | | |
|---|---|---|---|---|---|
| | | 1 | 2 | 3 | 4 |
| Acrylic monomer | EBECRYL145 | 5 | — | — | — |
| | NK Ester 9G | — | 5 | — | — |
| | NK Ester 14G | — | — | 5 | — |
| | Pentaerythritol triacrylate | — | — | — | 23.8 |

TABLE 5-continued

| Classification | Material name | Impregnating solution | | | |
|---|---|---|---|---|---|
| | | 1 | 2 | 3 | 4 |
| | Photopolymerizable polymer A solution (solution of 20% by mass) | — | — | — | 1.19 |
| Initiator | IRGACURE184 | 0.25 | 0.25 | 0.25 | 1.19 |
| Solvent | Methylethyl ketone | 100 | 100 | 100 | 100 |

*The numbers in the table represent the blending amounts of each material in parts by mass.*The materials listed in the table are as follows."EBECRYL145": product name; difunctional acrylic monomer manufactured by DAICEL-ALLNEX LTD.; PO modified neopentylglycol diacrylate (molecular weight of 328).
"NK Ester 9G": product name; difunctional acrylic monomer manufactured by Shin Nakamura Chemical Co., Ltd.; polyethylene glycol #400 dimethacrylate (molecular weight of 536).
"NK Ester 14G": product name; difunctional acrylic monomer manufactured by Shin Nakamura Chemical Co., Ltd.; polyethylene glycol #600 dimethacrylate (molecular weight of 736).
Pentaerythritol triacrylate: trifunctional acrylic monomer manufactured by Shin Nakamura Chemical Co., Ltd., trifunctional acrylic monomer (molecular weight of 298).Photopolymerizable polymer A solution (solution of 20% by mass): photopolymerizable acrylic polymer."IRGACURE184": product name; photopolymerization initiator (1-hydroxycyclohexylphenylketone) manufactured by BASF."IRGACURE127": product name; photopolymerization initiator (2-hydroxy-1-{4-[4-(2-hydroxy-2-methyl-propionyl)-benzyl]-phenyl}-2-methyl-propan-1-one) manufactured by BASF.

The numbers in the table represent the blending amounts of each material in parts by mass.

The materials listed in the table are as follows.

"EBECRYL145": product name; difunctional acrylic monomer manufactured by DAICEL-ALLNEX LTD.; PO modified neopentylglycol diacrylate (molecular weight of 328).

"NK Ester 9G": product name; difunctional acrylic monomer manufactured by Shin Nakamura Chemical Co., Ltd.; polyethylene glycol #400 dimethacrylate (molecular weight of 536).

"NK Ester 14G": product name; difunctional acrylic monomer manufactured by Shin Nakamura Chemical Co., Ltd.; polyethylene glycol #600 dimethacrylate (molecular weight of 736).

Pentaerythritol triacrylate: trifunctional acrylic monomer manufactured by Shin Nakamura Chemical Co., Ltd., trifunctional acrylic monomer (molecular weight of 298).

Photopolymerizable polymer A solution (solution of 20% by mass):

photopolymerizable acrylic polymer.

"IRGACURE184": product name; photopolymerization initiator (1-hydroxycyclohexylphenylketone) manufactured by BASF.

"IRGACURE127": product name; photopolymerization initiator (2-hydroxy-1-{4-[4-(2-hydroxy-2-methyl-propionyl)-benzyl]-phenyl}-2-methyl-propan-1-one) manufactured by BASF.

TABLE 6

| | Resin layer | Impregnation treatment | Impregnation time |
|---|---|---|---|
| Example 1 | Coating material for resin layer 1 | Impregnating solution 1 | 2 seconds |
| Example 2 | Coating material for resin layer 2 | Impregnating solution 1 | 2 seconds |
| Example 3 | Coating material for resin layer 1 | Impregnating solution 1 | 10 minutes |
| Example 4 | Coating material for resin layer 1 | Impregnating solution 2 | 2 seconds |
| Example 5 | Coating material for resin layer 1 | Impregnating solution 3 | 2 seconds |
| Example 6 | Coating material for resin layer 1 | Impregnating solution 1 | 2 seconds |
| Example 7 | Coating material for resin layer 1 | Impregnating solution 1 | 2 seconds |
| Example 8 | Coating material for resin layer 1 | Impregnating solution 1 | 2 seconds |
| Example 9 | Coating material for resin layer 1 | Impregnating solution 1 | 2 seconds |
| Example 10 | Coating material for resin layer 1 | Impregnating solution 1 | 1 minute |
| Example 11 | Coating material for resin layer 1 | Impregnating solution 1 | 3 minutes |
| Example 12 | Coating material for resin layer 3 | Impregnating solution 1 | 2 seconds |
| Example 13 | Coating material for resin layer 4 | Impregnating solution 1 | 2 seconds |
| Example 14 | Coating material for resin layer 5 | Impregnating solution 1 | 2 seconds |
| Example 15 | Coating material for resin layer 6 | Impregnating solution 1 | 2 seconds |
| Example 16 | Coating material for resin layer 7 | Impregnating solution 1 | 2 seconds |
| Comparative Example 1 | Coating material for resin layer 11 | — | — |
| Comparative Example 2 | Coating material for resin layer 8 | Impregnating solution 1 | 2 seconds |
| Comparative Example 3 | Coating material for resin layer 9 | Impregnating solution 1 | 2 seconds |
| Comparative Example 4 | Coating material for resin layer 10 | — | — |
| Comparative Example 5 | Coating material for resin layer 1 | Impregnating solution 4 | 2 seconds |
| Comparative Example 6 | Coating material for resin layer 12 | — | — |

TABLE 7

| | Carbon black volatile content % | A1 ° C. | A2 ° C. | T1 ° C. | T2 ° C. | T3 ° C. | H1 N/mm$_2$ | H2 N/mm$_2$ | Molecular weight of monovalent substituent | Film thickness of surface layer μm | Scratch evaluation rank | Filming evaluation rank |
|---|---|---|---|---|---|---|---|---|---|---|---|---|
| Example 1 | 2.10 | 395.2 | 392.2 | 382.3 | 378.2 | 379.3 | 1.09 | 0.82 | 560 | 15 | A | A |
| Example 2 | 0.41 | 395.1 | 392.1 | 382.2 | 378.1 | 379.2 | 1.08 | 0.81 | 560 | 15 | A | A |
| Example 3 | 2.11 | 395.1 | 392.1 | 382.2 | 382.2 | 382.2 | 1.08 | 1.08 | 560 | 15 | A | B |
| Example 4 | 2.10 | 395.1 | 392.1 | 382.2 | 381.1 | 381.2 | 0.11 | 0.81 | 560 | 15 | A | A |
| Example 5 | 2.12 | 395.1 | 392.1 | 382.2 | 381.3 | 381.6 | 0.11 | 0.81 | 560 | 15 | B | A |
| Example 6 | 2.01 | 395.1 | 392.1 | 382.2 | 378.1 | 379.2 | 1.08 | 0.81 | 560 | 2 | A | A |
| Example 7 | 2.13 | 395.2 | 392.2 | 382.3 | 378.2 | 379.3 | 1.09 | 0.82 | 560 | 150 | A | A |
| Example 8 | 2.15 | 395.2 | 392.2 | 382.3 | 378.2 | 379.3 | 1.09 | 0.82 | 560 | 1.4 | B | A |
| Example 9 | 2.10 | 395.2 | 392.2 | 382.3 | 378.2 | 379.3 | 1.09 | 0.83 | 560 | 160 | A | B |
| Example 10 | 2.09 | 395.1 | 392.1 | 382.2 | 378.1 | 380.1 | 1.08 | 1.08 | 560 | 15 | A | A |
| Example 11 | 2.11 | 395.1 | 392.1 | 382.2 | 378.1 | 380.3 | 1.08 | 0.81 | 560 | 15 | A | B |
| Example 12 | 2.14 | 395.2 | 392.2 | 385.2 | 381.2 | 382.2 | 1.15 | 0.96 | 560 | 15 | A | A |
| Example 13 | 2.08 | 395.1 | 392.1 | 382.2 | 378.1 | 379.2 | 1.21 | 1.03 | 560 | 15 | A | B |
| Example 14 | 2.07 | 395.1 | 392.1 | 382.2 | 378.1 | 379.2 | 1.08 | 0.81 | 2450 | 15 | A | A |
| Example 15 | 2.15 | 395.1 | 392.1 | 382.2 | 378.1 | 379.2 | 1.08 | 0.81 | 3250 | 15 | B | A |
| Example 16 | 2.10 | 395.2 | 392.2 | 382.3 | 378.2 | 379.3 | 1.09 | 0.82 | — | 15 | B | A |
| Comparative Example 1 | 2.10 | 380.2 | 380.2 | 378.2 | 378.2 | 378.2 | 0.83 | 0.83 | 560 | 15 | C | A |
| Comparative Example 2 | 2.12 | 392.0 | 392.0 | 365.0 | 365.0 | 365.0 | 0.82 | 0.81 | 560 | 15 | C | C |
| Comparative Example 3 | 0.32 | 395.2 | 392.2 | 382.3 | 378.2 | 379.3 | 1.09 | 0.82 | 560 | 15 | C | A |
| Comparative Example 4 | 2.12 | — | — | 401.2 | 401.2 | 401.2 | 3.22 | 3.22 | 560 | 15 | C | C |
| Comparative Example 5 | 2.13 | 395.0 | 395.0 | — | 378.0 | 390.0 | 4.00 | 0.80 | 560 | 15 | C | C |
| Comparative Example 6 | 2.13 | — | 390.1 | 378.1 | 378.1 | 378.1 | 0.81 | 0.81 | 560 | 15 | C | B |

[Discussion of Evaluation Results]

Each of the electrophotographic members of Examples 1 to 17 has a single elastic layer as a surface layer. The surface layer includes a binder resin and carbon black dispersed in the binder resin, and the binder resin includes a crosslinked urethane resin and a crosslinked acrylic resin. Further, the electrophotographic members of Examples 1 to 17 all satisfy the condition of A1>A2. In the first area from the outer surface of the surface layer to a depth of 0.1 μm, it can be confirmed that the crosslinked urethane resin and the crosslinked acrylic resin form an IPN structure. In addition, the carbon black has the volatile content of 0.4% or more, whereby even in the durability evaluation by printing of an extremely large number of sheets under a high temperature environment, occurrence of scratches and filming due to scraping are suppressed.

When Example 1 and Example 3 are compared, T1=T2 in Example 3, T1>T2 in Example 1, and thus, scratches and filming due to scraping are suppressed at a higher level in Example 1.

When Example 4 and Example 5 are compared, in Example 4, (T1−T2)>1.0 (° C.), and thus, scratches due to scraping can be effectively suppressed.

When Example 8 and Example 9 are compared with Examples 1, 6, and 7, in Examples 1, 6, and 7, a film thickness of the surface layer is 2.0 μm or more and 150.0 μm or less, whereby a balance between strength and flexibility of the film is good and scratches and filming due to scraping are suppressed at a high level. When Example 10 and Example 11 are compared, in Example 10, T1>T3 and |T1−T3|>|T3−T2| are satisfied, and thus, scratches and filming due to scraping are suppressed at a high level. When Examples 3 and 13 are compared with Examples 1 and 12, in Examples 1 and 12, H1>H2 and also H2<1.0(N/mm$^2$), and thus, scratches and filming due to scraping are suppressed at a high level.

In addition, from comparison of Example 1 with Example 16, it can be seen that the developing roller according to Example 1 having a partial structure represented by Structural Formula (2) at the end of the crosslinked urethane resin has further enhanced effect of scratch prevention, as compared with the developing roller according to Example 16 which does not have the partial structure.

On the other hand, since Comparative Example 1 includes the chain acrylic resin but does not include the IPN structure of the crosslinked acrylic resin and the crosslinked urethane resin, occurrence of scratches is seen.

In Comparative Example 2, the thermoplastic urethane resin is included as the resin layer, but the crosslinked urethane resin is not used, and thus, scratches occur. Also, filming was also confirmed.

In Comparative Example 3, the carbon black has a low volatile content, and thus, scratches due to scraping occur.

In Comparative Example 4, a highly crosslinked urethane resin is prepared using a low molecular weight diol, but the flexibility is low, so that scratches due to scraping occur, and also a load on the toner is increased due to the higher hardness, occurrence of filming is seen.

In Comparative Example 5, most of the photopolymerizable polymer A is not impregnated in the resin layer and is exposed to the surface, and thus, the component derived from the crosslinked urethane resin was not able to be confirmed in the surface microsampilng mass spectrometry. Accordingly, the interpenetrating polymer network structure of the crosslinked acrylic resin and the crosslinked urethane resin is not formed on the outermost surface, and thus, scratches and filming due to scraping occur.

In Comparative Example 6, the crosslinked acrylic particles are included in the resin layer, but a step of impregnating the outer surface of the resin layer with the liquid acrylic monomer and a step of curing the impregnated acrylic monomer are not performed. Therefore, the IPN structure of the crosslinked acrylic resin and the crosslinked urethane resin is not formed, and thus, occurrence of scratches due to scraping is seen.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-123388, filed Jun. 28, 2018, which is hereby incorporated by reference herein in its entirety.

What is claimed is:

1. An electrophotographic member comprising: an electroconductive substrate; and a single elastic layer as a surface layer, wherein the surface layer includes a binder resin and carbon black dispersed in the binder resin, the carbon black has a volatile content of 0.4% or more, the binder resin includes a crosslinked urethane resin and a crosslinked acrylic resin, and wherein the surface layer has a first area in which the crosslinked urethane resin and the crosslinked acrylic resin form an interpenetrating polymer network structure, the first area being from an outer surface of the surface layer to a depth of 0.1 μm in the surface layer.

2. The electrophotographic member according to claim 1, wherein when the peak top temperature of the thermal chromatogram derived from the crosslinked urethane resin in the first area is defined as T1(° C.), and the peak top temperature of the thermal chromatogram derived from the crosslinked urethane resin in a second area having a thickness of 0.1 μm from a back surface of the surface layer, opposing to the electroconductive substrate toward the outer surface is defined as T2(° C.), T1 and T2 satisfy a relationship represented by the following Equation (2):

$$T1>T2 \quad (2).$$

3. The electrophotographic member according to claim 2, wherein T1 and T2 satisfy a relationship represented by the following Equation (3):

$$(T1-T2)>1.0(^\circ\ \mathrm{C.}) \quad (3).$$

4. The electrophotographic member according to claim 1, wherein a thickness of the surface layer is 2.0 μm or more and 150.0 μm or less.

5. The electrophotographic member according to claim 4, wherein when the peak top temperature of the thermal chromatogram derived from the crosslinked urethane resin in a third area from the outer surface of the surface layer to a depth of 1.0 μm or more and 1.1 μm or less is defined as T3 (° C.), T1, T2, and T3 satisfy relationships represented by the following Equation (4) and Equation (5):

$$T1>T3 \quad (4);$$

$$|T1-T3|>|T3-T2| \quad (5).$$

6. The electrophotographic member according to claim 1, wherein when Martens hardness in the outer surface of the surface layer is defined as H1 (N/mm$^2$) and Martens hardness in a back surface of the surface layer, opposing to the electroconductive substrate is defined as H2 (N/mm$^2$), relationships represented by the following Equation (6) and Equation (7) are satisfied:

$$H1>H2 \quad (6);$$

$$H2<1.0\ (\mathrm{N/mm^2}) \quad (7).$$

7. The electrophotographic member according to claim 1, wherein the crosslinked urethane resin has a structure represented by the following Structural Formula (1):

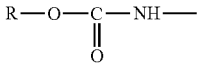

(1)

wherein R represents an organic group which contains an oxyalkylene structure with which a number average molecular weight (Mn) of a portion of a structure represented by Structural Formula (1) is 500 or more and 3500 or less and does not have a cyclic structure.

8. An electrophotographic process cartridge configured to be detachably attachable to a main body of an electrophotographic apparatus, comprising an electrophotographic member, wherein the electrophotographic member has an electroconductive substrate and a single elastic layer as a surface layer, the surface layer includes a binder resin and carbon black dispersed in the binder resin, the carbon black has a volatile content of 0.4% or more, the binder resin includes a crosslinked urethane resin and a crosslinked acrylic resin, and wherein the surface layer has a first area in which the crosslinked urethane resin and the crosslinked acrylic resin form an interpenetrating polymer network structure, the first area being from an outer surface of the surface layer to a depth of 0.1 μm in the surface layer.

9. The electrophotographic process cartridge according to claim 8, wherein the electrophotographic process cartridge is provided with the electrophotographic member as a developing member.

10. An electrophotographic image forming apparatus, comprising: an image carrier for carrying an electrostatic latent image, a charging device for primarily charging the image carrier, an exposure device for forming the electrostatic latent image on the primarily charged image carrier, a developing member for forming a toner image by developing the electrostatic latent image by toner, and a transfer device for transferring the toner image to a transfer material, wherein the developing member has an electroconductive substrate and a single elastic layer as a surface layer, the surface layer includes a binder resin and carbon black dispersed in the binder resin, the carbon black has a volatile content of 0.4% or more, the binder resin includes a crosslinked urethane resin and a crosslinked acrylic resin, and wherein the surface layer has a first area in which the crosslinked urethane resin and the crosslinked acrylic resin form an interpenetrating polymer network structure, the first area being from an outer surface of the surface layer to a depth of 0.1 μm in the surface layer.

11. An electrophotographic member comprising: an electroconductive substrate; and a single elastic layer as a surface layer, wherein the surface layer includes a binder resin and carbon black dispersed in the binder resin, the carbon black has a volatile content of 0.4% or more, the binder resin includes a crosslinked urethane resin and a crosslinked acrylic resin, the surface layer has a first area in which the crosslinked urethane resin and the crosslinked acrylic resin are included, the first area being from an outer surface of the surface layer to a depth of 0.1 μm in the surface layer, and when sampling a first sample from the first area, and a peak top temperature of a thermal chromatogram derived from the crosslinked acrylic resin in the first sample is defined as A1 (° C.) and when obtaining a second sample by decomposing the crosslinked urethane resin in the first sample, and a peak top temperature of a thermal chromatogram derived from the crosslinked acrylic resin in the second sample is defined as A2 (° C.), A1 and A2 satisfy a relationship represented by the following Equation (1):

$$A1>A2 \quad (1).$$

* * * * *